United States Patent [19]

Visos et al.

[11] 4,289,476

[45] Sep. 15, 1981

[54] DIRECT IGNITION GAS BURNER CONTROL SYSTEM

[75] Inventors: Charles D. Visos; Carl F. Fernstrom, both of St. Louis County, Mo.

[73] Assignee: Emerson Electric Co., St. Louis, Mo.

[21] Appl. No.: 56,502

[22] Filed: Jul. 11, 1979

[51] Int. Cl.[3] ..... F23N 5/00

[52] U.S. Cl. ..... 431/66; 431/46; 431/74

[58] Field of Search ..... 431/46, 58, 66, 78, 431/69, 67, 72, 71, 43, 74; 137/65

[56] References Cited

U.S. PATENT DOCUMENTS

| | | | |
|---|---|---|---|
| Re. 25,976 | 3/1966 | Matthews | 431/66 |
| 2,269,157 | 1/1942 | Levine | 431/74 |
| 3,059,693 | 10/1962 | Hotchkiss | 431/66 |
| 3,603,708 | 9/1971 | Good | 431/66 |
| 4,111,640 | 9/1978 | Scott | 431/46 |

*Primary Examiner*—Samuel Scott
*Assistant Examiner*—Lee E. Barrett
*Attorney, Agent, or Firm*—Paul A. Becker, Sr.

[57] ABSTRACT

In a direct ignition gas burner control system wherein two valves are connected fluidically in series with the burner, a make-before-break thermostatically actuated switch is effective, when a set of "cold" contacts are made, to energize an electrical resistance igniter and to open a first of the two valves which opening enables a pressure actuated switch to close its contacts. When the igniter is above a temperature sufficient to ignite gas, the thermostatically actuated switch makes a set of "hot" contacts while its "cold" contacts are still made. In this intermediate contact position, a second of the two valves is opened, allowing gas to flow to the burner. Continued energizing of the igniter causes the thermostatically actuated switch to break its "cold" contacts, effecting de-energizing of the igniter. When the "cold" contacts are open, the pressure actuated switch provides a hold-in circuit for the valves. The transitory intermediate contact position of the thermostatically actuated switch is of sufficient time duration so that, in the event the pressure switch contacts momentarily open due to a drop in pressure when the second valve opens, the valves will remain open.

4 Claims, 3 Drawing Figures

DIRECT IGNITION GAS BURNER CONTROL SYSTEM

This invention relates to electrically operated control systems for controlling operation of a main gas burner wherein the burner is directly ignited by an electrical resistance igniter.

In our pending application Ser. No. 28,338, now U.S. Pat. No 4,243,373, filed Apr. 9, 1979, for DIRECT IGNITION GAS BURNER CONTROL SYSTEM, assigned to the assignee of the present invention, we disclose a control system including an igniter, a pressure actuated switch, a thermostatically actuated switch, a gas valve device including two valves connected fluidically in series with the burner, two relays, and appropriate circuit connections for effecting control of a main gas burner.

In the referenced application, upon a call for heat the igniter is energized and the first of the two valves connected fluidically in series is opened through circuit means including the thermostatically actuated switch in a first "cold" contact position. In response to gas pressure when the first valve is open, the pressure actuated switch is actuated to a closed contact position to provide a circuit in parallel with the "cold" contacts of the thermostatically actuated switch. In response to the igniter being heated to a temperature above that required to ignite gas, the thermostatically actuated switch is moved out of its first "cold" contact position into a second "hot" contact position. The pressure actuated switch, being in parallel with the "cold" contacts of the thermostatically actuated switch, provides a hold-in circuit for maintaining the first valve open when the thermostatically actuated switch is moved out of its "cold" contact position. When the thermostatically actuated switch is in its "hot" contact position, the second of the two valves is opened, enabling gas to flow to the burner, and the igniter is de-energized.

The system of the referenced application, primarily due to the employment of the pressure actuated switch, performs quite satisfactorily under various abnormal operating conditions such as an electrical power failure, a gas pressure failure, or an ignition failure, as discussed in detail in the referenced application. A problem is encountered, however, in some system applications wherein a gas regulator, commonly referred to as a service regulator and located upstream from the gas valve device, is too sluggish to respond quickly to the change in gas pressure caused by the opening of the second valve. Specifically, when the second valve in the referenced system opens, gas immediately flows through the valve device to the burner. If the service regulator does not respond quickly enough to the resulting pressure change, gas pressure at the valve device drops below the value required to maintain the pressure actuated switch in its closed contact position. Should the contacts of the pressure actuated switch open, the first valve closes, thus stopping the flow of gas to the burner. While this problem can be eliminated by adjusting or replacing the defective service regulator, it is considered more desirable to provide a control system which will function satisfactorily under this abnormal condition.

An object of this invention, therefore, is to provide a generally new and improved electrical control system for a main gas burner ignited by an electrical resistance igniter wherein two valves are connected fluidically in series with the burner; wherein a pressure actuated switch is effective, when in a closed contact position, to provide a hold-in circuit for the two valves; and wherein a thermostatically actuated switch is effective to open a second of the two valves and provide a temporary hold-in circuit for the two valves for a sufficient time period so as to prevent the first valve from closing due to opening of the pressure actuated switch contacts when the second valve opens.

A further object is to provide a burner control system as in the preceding paragraph wherein the thermostatically actuated switch includes "cold" contacts electrically in parallel with the pressure actuated switch, "hot" contacts electrically in series with the pressure actuated switch, and a transitory intermediate contact position in which both the "cold" and "hot" contacts are made; wherein the thermostatically actuated switch, when its "cold" contacts are closed, effects energizing of the igniter and opening of the first valve; wherein the thermostatically actuated switch is moved in response to heat from the igniter to its intermediate contact position when the igniter is above a temperature sufficient to ignite gas for effecting opening of the second valve; and wherein the thermostatically actuated switch is subsequently moved to its "hot" contact position, wherein the "hot" contacts are closed and the "cold" contacts are open, in response to continued energizing of the igniter for effecting de-energizing of the igniter, the thermostatically actuated switch being in its intermediate contact position for a sufficiently long time period to prevent closing of the first valve in the event that the pressure actuated switch contacts should open due to a drop in gas pressure when the second valve opens.

Further objects and advantages will appear from the following description when read in conjunction with the accompanying drawings.

DESCRIPTION OF THE PREFERRED EMBODIMENT

Figure 1:
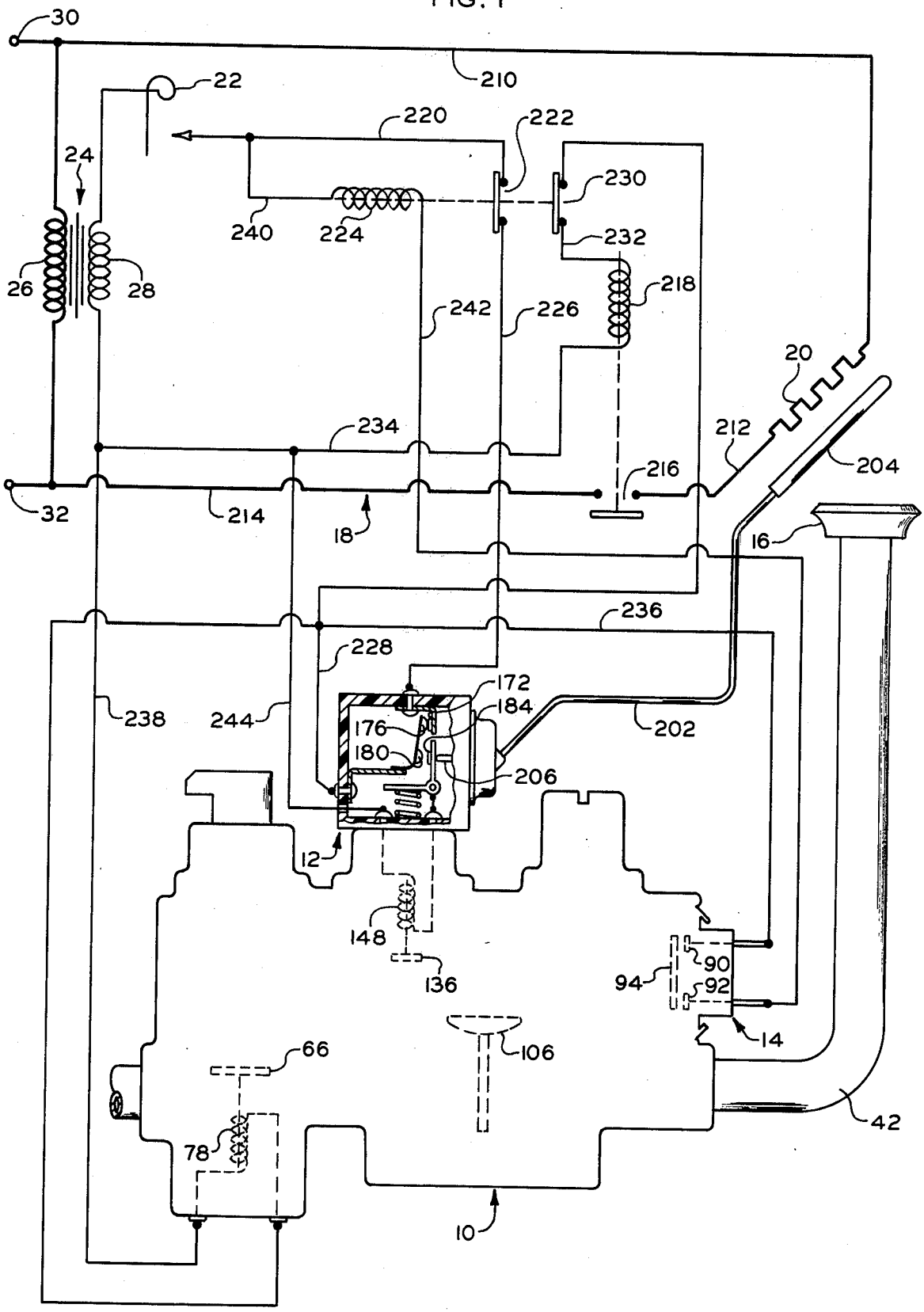
FIG. 1 is a diagrammatic illustration of a burner control system constructed in accordance with the present invention.

Referring to FIG. 1, the control system includes, as primary elements, a manifold gas valve device generally indicated at 10 and including therein a thermostatically actuated switch 12 and a pressure actuated switch 14, a main burner 16, and an electrical control circuit 18. Control circuit 18 includes an electrical resistance igniter 20, a space thermostat 22, and a voltage step down transformer 24 having a primary winding 26 and a secondary winding 28. Primary winding 26 is connected across terminals 30 and 32 of a conventional 120 volt alternating current power source.

DESCRIPTION OF THE MANIFOLD GAS VALVE DEVICE

Except for the construction of thermostatically actuated switch 12 and the addition of a restricting orifice, manifold gas valve device 10 is the same as that disclosed in the above referenced patent application Ser. No. 28,338.

Figure 2:
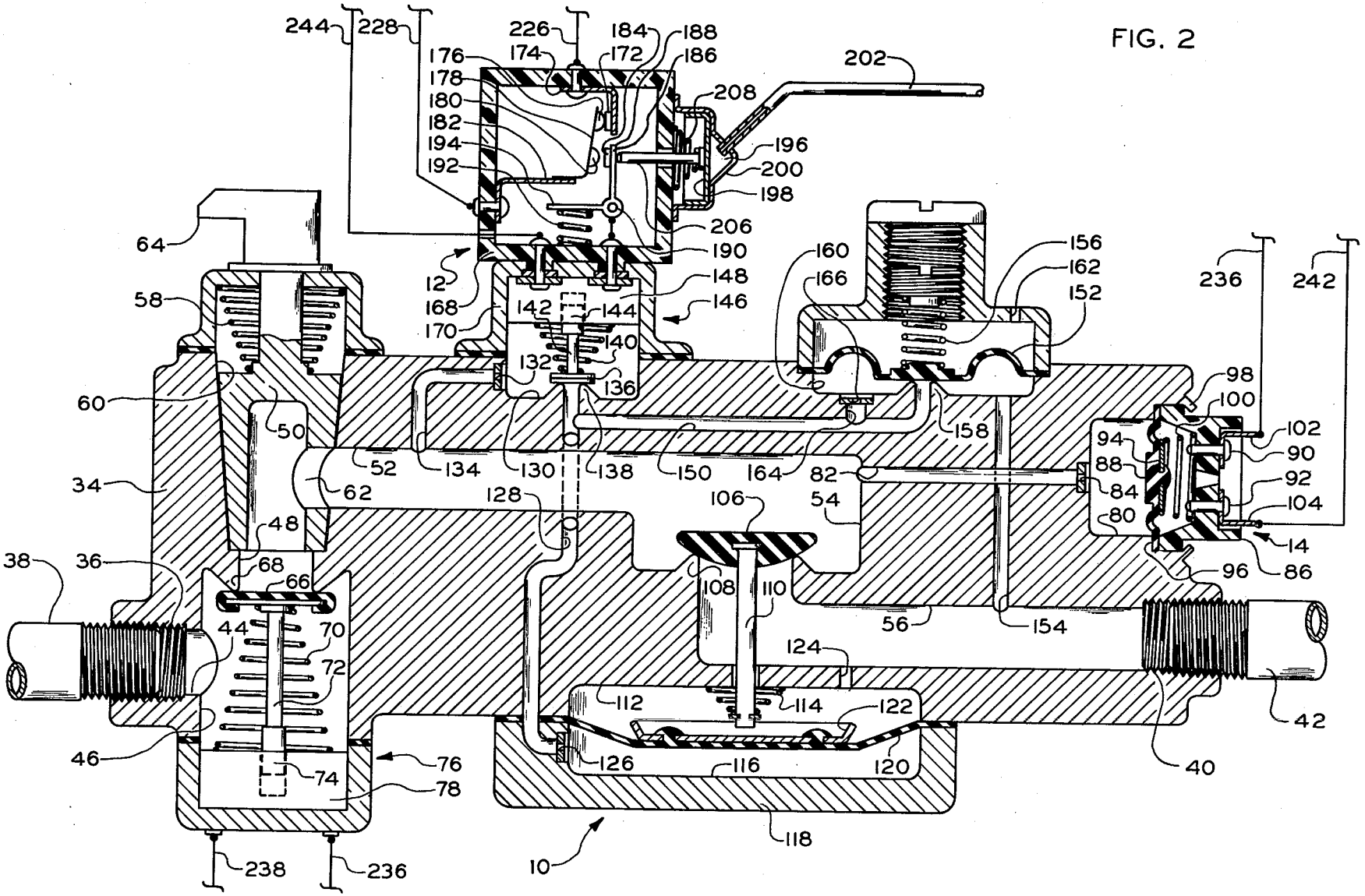
FIG. 2 is a cross sectional view of the gas valve device employed in the control system of FIG. 1.

Referring to FIG. 2 of the drawings, the manifold gas valve device 10 comprises a body 34 having an inlet 36 receiving a gas supply conduit 38 from a gas source (not shown), and an outlet 40 receiving a gas conduit 42 leading to the main burner 16 shown in FIG. 1. Connecting inlet 36 and outlet 40 is a main fuel passageway means including an inlet passage 44, a chamber 46, a passage 48, a hollow rotary plug cock 50, a passage 52, a chamber 54, and an outlet passage 56.

Plug cock 50 is biased downwardly by a spring 58 into seating engagement in a vertical tapered bore 60 in body 34 and has a port 62 in the wall thereof which registers with passage 52 when the plug cock 50 is rotated by means of an attached knob 64 to an "on" position.

A biased closed electromagnetically opened primary control valve 66 cooperates with an annular seat 68 formed at the lower end of passage 48 to control all gas flow through the manifold valve device 10. The valve 66 is biased closed on seat 68 by a spring 70 and has a stem 72 connected to the plunger 74 of a solenoid 76 having a winding 78. Valve 66 is opened when winding 78 is energized and is closed by spring 70 when winding 78 is de-energized.

Whenever valve 66 is open and plug cock 50 is in the "on" position wherein port 62 registers with passage 52, gas is supplied via passage 52 and chamber 54 to a diaphragm chamber 80 which operates the pressure actuated switch 14, chamber 80 being in communication with chamber 54 through a passage 82 and an orifice 84. Chamber 80 is formed as a bottom portion of a stepped circular cavity in valve body 34. Secured in a larger diameter top portion of the stepped circular cavity is the pressure actuated switch 14.

Switch 14 comprises a rigid circular cup-shaped member 86 formed of dielectric material, a flexible circular diaphragm member 88 also formed of dielectric material, solid rivet type stationary contacts 90 and 92 secured in spaced relationship in cup member 86, and a movable contact 94 attached to the central portion of diaphragm member 88. Peripheral portions of the cup-shaped member 86 and the diaphragm member 88 are received in the stepped circular cavity with the peripheral portion of the diaphragm member 88 lying against an annular shoulder 96 formed between the bottom and top portions of the cavity and with the peripheral portion of the cup-shaped member 86 overlying the peripheral portion of diaphragm member 88. The peripheral portion of the cup-shaped member 86 is pressed against the diaphragm member 88 and shoulder 96 and held firmly fixed by staking as indicated at 98. The diaphragm member 88 and attached movable contact 94 are biased away from stationary contacts 90 and 92 by a spring 100. Attached to stationary contacts 90 and 92 and extending outwardly therefrom are connector terminals 102 and 104, respectively.

A valve 106 cooperates with an annular valve seat 108 formed in chamber 54 for controlling gas flow to outlet passage 56 and main burner 16. Valve 106 has a stem 110 extending downwardly into an upper diaphragm chamber 112 formed as a recess in valve body 34, and a spring 114 biases valve 106 downwardly to a closed position on its seat 108. A lower diaphragm chamber 116 is formed by a cup-shaped member 118 attached by any suitable means to valve body 34. A flexible diaphragm 120 is clamped at its periphery between body 34 and member 118 and forms a flexible wall between upper and lower diaphragm chamber 112 and 116 respectively. A relatively rigid metal disc 122 is centrally positioned and attached to diaphragm 120 and is effective to engage the lower end of the valve stem 110 and move valve 106 upwardly toward an open position when sufficient gas pressure is applied to the lower side of diaphragm 120.

The upper diaphragm chamber 112 is adequately vented to outlet passage 56 through a vent 124 so that the upper side of diaphragm 120 is constantly exposed to the pressure existing in outlet passage 56. The lower diaphragm chamber 116 communicates with inlet passage 44 through an orifice 126, a passage 128, a valve chamber 130, an orifice 132, a passage 134, passage 52, port 62, plug cock 50, passage 48, and chamber 46. A biased closed electromagnetically opened valve 136 cooperates with an annular valve set 138 formed around the entrance of passage 128 into valve chamber 130 to control the admission of inlet gas to the lower diaphragm chamber 116. Valve 136 is biased closed on seat 138 by a spring 140 and has a stem 142 connected to the plunger 144 of a solenoid 146 having a winding 148. Valve 136 is opened when winding 148 is energized and is closed by spring 140 when winding 148 is de-energized.

When valves 66 and 136 are open, gas pressure is applied to the lower diaphragm chamber 116 through orifice 132, chamber 130, passage 128, and orifice 126 to effect opening of valve 106. Gas also flows through a variable bleed-off passage means leading from passage 128 to outlet passage 56, the variable bleed-off passage means comprising a passage 150 connected to passage 128, a diaphragm type pressure regulator valve 152, and a passage 154 connected to outlet passage 56. Pressure regulator valve 152 is biased by an adjustable spring 156 toward a closed position on an annular seat 158 formed around the entrance of passage 150 into a valve chamber 160. The side of valve 152 opposite that facing valve chamber 160 is exposed to atmospheric pressure through a vent 162. This variable bleed-off means varies the bleed-off rate through passage 150 in response to outlet pressure variations so as to maintain a predetermined outlet pressure.

Connected between passage 150 and pressure regulator valve chamber 160, bypassing pressure regulator valve 152, is a fixed or constant bleed-off passage means comprising a passage 164 and an orifice 166. When valve 66 or valve 136 closes, pressure regulator valve 152 closes quickly. While lower diaphragm chamber 116 begins to exhaust past closing pressure regulator valve 152, it completes its exhausting through passage 164 and orifice 166, enabling valve 106 to close, Orifice 126 is sufficiently small so as to retard the exhausting of lower diaphragm chamber 116, and thus retard the closing of valve 106, until chamber 80 in pressure actuated switch 14 is exhausted past valve 106 a sufficient amount to enable the disconnecting of contacts 90 and 92 therein.

Thermostatically actuated switch 12 comprises a casing 168 mounted in any suitable manner on a housing member 170 of solenoid 146. A stationary contact 172 is mounted on a bracket 174 secured to casing 168. Cooperating with contact 172 is a contact 176 mounted on a resilient switch blade 178. Also mounted on switch blade 178 and spaced from contact 176 is a contact 180. Resilient switch blade 178 is attached to a bracket 182 which is secured to casing 168.

Cooperating with contact 180 is a movable contact 184 mounted on one leg 186 of a switch blade 188 pivoted on a pin 190. A spring 192, between casing 168 and another leg 194 of switch blade 188, biases movable contact 184 away from contact 180, enabling contacts 172 and 176 to make when switch 12 is in a "cold" contact position. While contacts 176 and 180 are illustrated as two separate contacts, it is to be understood that a single contact, capable of connecting with contacts 172 and 184, can be employed.

An expansible chamber 196 is defined by an inner flexible metal cup 198 and an outer rigid metal cup 200, cup 200 being attached to switch casing 168. Chamber 196 is connected by a capillary tube 202 to a bulb 204, shown in FIG. 1, mounted between igniter 20 and burner 16. The expansible chamber 196, capillary tube 202, and bulb 204 comprise a sealed system filled with a thermally expansible fluid, such as mercury, with bulb 204 positioned so as to be responsive to the heat from igniter 20 and so as to be impinged by the burner flame. An actuator rod 206 is biased at one end by a spring 208 against the inner flexible cup 198 and at its other end bears against leg 186 of switch blade 188.

Upon expansion of the expansible chamber 196 caused by heating of bulb 204 by igniter 20, actuator rod 206 causes pivoted switch blade 188 to pivot counterclockwise about pin 190, causing movable contact 184 to make with contact 180 on resilient switch blade 178. When contacts 184 and 180 are intially connected, contacts 172 and 176 remain connected. This make-before-break switch construction provides an intermediate contact position wherein contacts 172 and 176 are made and contacts 184 and 180 are made, for purposes to be hereinafter described. This intermediate contact position is transitory, existing for only a second or two. As switch blade 178 continues to pivot due to continuing expansion of chamber 196, resilient switch blade 178 is flexed to the left, referring to FIG. 2. and contacts 172 and 176 are disconnected. When this switching is completed, switch 12 is in its "hot" contact position, wherein contacts 172 and 176 are disconnected and contacts 184 and 180 are connected.

DESCRIPTION OF THE ELECTRICAL CONTROL CIRCUIT

Referring to FIG. 1 of the drawings, electrical resistance igniter 20 is connected by a lead 210 to power source terminal 30 and by leads 212 and 214 and a set of normally-open contacts 216 of a relay having a winding 218 to the other power source terminal 32.

Relay winding 218 is connected across secondary winding 28 of transformer 24 through thermostat 22, a lead 220, a set of normally-closed contacts 222 of a relay having a winding 224, a lead 226, "cold" contacts 172 and 176 of switch 12, a lead 228, another set of normally-closed contacts 230 controlled by relay winding 224, a lead 232, relay winding 218, and a lead 234. It should be noted that although igniter 20 is preferably of a type adapted to be energized by 120 volts, igniters capable of being energized by a lower voltage, such as 24 volts, can also be utilized. With such a lower voltage igniter, the igniter would be electrically connected where relay winding 218 is connected, and relay winding 218 and its contacts 216 would be omitted.

Solenoid winding 78, which controls valve 66 shown in more detail in FIG. 2, is connected across secondary winding 28 through thermostat 22, lead 220, normally-closed relay contacts 222, lead 226, "cold" contacts 172 and 176, lead 228, a lead 236, solenoid winding 78, and a lead 238.

When valve 66 is open, gas pressure effects the connection of contacts 90 and 92 by movable contact 94 in pressure actuated switch 14. When contacts 90 and 92 are connected by contact 94, a circuit is provided in parallel with normally-closed relay contacts 222 and "cold" contacts 172 and 176, the circuit being a lead 240, relay winding 224, a lead 242, contacts 92, 94, and 90 of pressure actuated switch 14, and lead 236.

When thermostatically actuated switch 12 is in its intermediate contact position wherein contacts 172 and 176 are connected and contacts 180 and 184 are also connected, solenoid winding 148 is connected across secondary winding 28 through thermostat 22, lead 220, normally-closed relay contacts 222, lead 226, contacts 172, 176, 180 and 184 of switch 12, solenoid winding 148, and a lead 244, to effect opening of valve 136.

When switch 12 is in its "hot" contact position wherein "hot" contacts 180 and 184 are connected and "cold" contacts 172 and 176 are disconnected, the above described parallel circuit comprising relay winding 224 and contacts 92, 94, and 90 of pressure actuated switch 14 is energized and functions, as will be hereinafter described, to provide a hold-in circuit for valve 66 and valve 136, to effect de-energizing of igniter 20, and to provide a desired manner of system operation under various abnormal operating conditions.

OPERATION OF THE SYSTEM

The gas valve device 10 is shown in FIG. 2 with electromagnetically operated valves 66 and 136 closed, with pressure operated valve 106 closed, with thermostatically actuated switch 12 in its "cold" contact position, with contacts 90 and 92 disconnected from contact 94 in pressure actuated switch 14, and with plug cock 50 rotated to its "on" position. Under these conditions, no gas is flowing to burner 16 and igniter 20 is de-energized.

When thermostat 22 closes, solenoid winding 78 is energized by secondary winding 28 through thermostat 22, lead 220, normally-closed relay contacts 222, lead 226, "cold" contacts 172 and 176 of switch 12, leads 228 and 236, solenoid winding 78, and lead 238. Energizing of winding 78 causes valve 66 to open, allowing inlet gas to flow through passage 82 and orifice 84 into chamber 80 of pressure actuated switch 14, causing its diaphragm member 88 to move outwardly and effect the connection of stationary contacts 90 and 92 by movable contact 94.

The connection of contacts 90 and 92 provides a circuit in parallel with normally-closed relay contacts 222 and "cold" contacts 172 and 176 of switch 12, the circuit being lead 240, relay winding 224, lead 242, contacts 92, 94, and 90 of pressure actuated switch 14, and lead 236. However, as long as relay contacts 222 are closed and "cold" contacts 172 and 176 are closed, this latter described circuit is shorted, preventing relay winding 224 from being energized.

Connected in parallel with solenoid winding 78 and also energized by secondary winding 28 when thermostat 22 closes is relay winding 218 which controls energizing of igniter 20, the circuit being lead 228, normally closed relay contacts 230, lead 232, relay winding 218, and lead 234. With relay winding 218 energized, its controlled contacts 216 close, causing igniter 20 to be connected across power source terminals 30 and 32 through leads 210 and 212, relay contacts 216, and lead 214. Electrical resistance igniter 20 begins to heat and the heat radiates to bulb 204.

As bulb 204 is heated, the liquid therein begins to expand, causing actuator rod 206 to move contact 184 toward contact 180 in thermostatically actuated switch 12. Bulb 204 is spaced with respect to igniter 20 so that when igniter 20 is above the ignition temperature of gas, the liquid in bulb 204 vaporizes, causing a rapid increase in movement of actuator rod 206. As the actuator rod 206 moves under these conditions "hot" contacts 180 and 184 are connected and, within a second or two, "cold" contacts 172 and 176 are disconnected.

When "hot" contacts 180 and 184 are initially connected due to the above described rapid movement of actuator rod 206, "cold" contacts 172 and 176 are still connected. With thermostatically actuated switch 12 in this intermediate contact position, solenoid winding 148, which controls valve 136, is energized by secondary winding 28 through thermostat 22, lead 220, normally-closed relay contacts 222, lead 226, contacts 172, 176, 180 and 184 of switch 12, winding 148, and leads 244 and 234. Referring to FIG. 2, opening of valve 136 permits gas to flow to the lower diaphragm chamber 116, increasing the pressure therein and causing valve 106 to be opened.

When valve 106 opens, gas flows into gas valve device 10 from a gas source, generally through a service regulator (not shown). If the service regulator does not respond quickly enough to the gas flow requirement caused by the opening of valve 106, gas flow through gas valve device 10 is momentarily delayed. As soon as the service regulator responds, gas flows to burner 16 to be ignited by igniter 20.

The above described momentary delay may permit chamber 80 in pressure actuated switch 14 to exhaust sufficiently to enable its contacts 90, 92, and 94 to be disconnected. As soon as gas flows, however, contacts 90, 92, and 94 are again connected. Because of the make-before-break construction of thermostatically actuated switch 12, this potential momentary opening and closing of contacts 90, 92, and 94 has no effect on system operation. Specifically, switch 12 is constructed so that it is in its intermediate contact position for a time period longer than the time period during which the above described momentary opening and closing of contacts 90, 92, and 94 occurs. With "cold" contacts 172 and 176 and "hot" contacts 180 and 184 closed, relay winding 218 and solenoid windings 78 and 148 remain energized, whereby igniter 20 remains energized and valves 66 and 136 remain open, regardless of whether contacts 90, 92, and 94 are open or closed.

As previously described, switch 12 is in its intermediate contact position for only a second or two. Subsequent movement of actuator rod 206 causes "cold" contacts 172 and 176 to be disconnected while "hot" contacts 180 and 184 remain connected.

With "cold" contacts 172 and 176 disconnected, relay winding 224 is energized through contacts 90, 92, and 94 of pressure actuated switch 14 and a three-branch parallel circuit in series with relay winding 224 and contacts 90, 92, and 94. Specifically, when "cold" contacts 172 and 176 are disconnected, a circuit is completed from secondary winding 28, through thermostat 22, lead 240, relay winding 224, lead 242, contacts 92, 94, and 90 of switch 14, and lead 236 through a first circuit comprising solenoid winding 78 and lead 238, through a second parallel connected circuit comprising lead 228, "hot" contacts 180 and 184, solenoid winding 148, and lead 244, and through a third parallel connected circuit comprising lead 228, relay contacts 230, lead 232, relay winding 218, and lead 234. When relay winding 224 is connected as described, it is sufficiently energized to effect opening of its normally-closed contacts 222 and 230.

With relay contacts 222 open, desired system operation under various abnormal operating conditions is assured, as will be hereinafter described.

When relay contacts 230 open, relay winding 218 is deenergized, causing its controlled contacts 216 to open and effect de-energizing of igniter 20. After igniter 20 is deenergized, switch 12 is maintained in its "hot" contact position by impingement of burner flame on bulb 204.

Under normal burner operation, burner 16 will continue to burn until thermostat 22 opens. When thermostat 22 opens, solenoid winding 78 and 148 are de-energized, effecting the immediate closing of valves 66 and 136, respectively. When valves 66 and 136 close, gas pressure is no longer applied to pressure regulator valve 152 so that it begins to close on its seat 158. Concurrently, gas pressure is no longer applied to lower diaphragm chamber 116 and the existing pressure therein begins to exhaust to lower, atmospheric pressure in outlet passage 56. An exhaust route for lower diaphragm chamber 116 is through orifice 126, passage 128 and 150, past closing regulator valve 152, chamber 160, and passage 154. Another exhaust route, which ensures sufficient exhausting when regulator valve 152 is fully seated, is through orifice 126, passages 128, 150, and 164, orifice 166, chamber 160, and passage 154. When diaphragm chamber 116 is sufficiently exhausted, valve 106 closes under the bias of spring 114.

For reasons to be hereinafter described, it is necessary, when valves 66 and 136 close, that chamber 80 of pressure actuated switch 14 be exhausted to effect disconnecting of its contacts 90, 92, and 94. Since the only route for gas to exhaust from chamber 80 is past valve 106, it is necessary that valve 106 remain open for a sufficient period of time after the closing of valves 66 and 136 to enable this exhausting to occur. Accordingly, orifice 126 in passage 128 is made sufficiently small so as to retard the exhausting of lower diaphragm chamber 116 thus allowing sufficient time for chamber 80 to exhaust past valve 106 before valve 106 closes.

It should be noted that orifice 126 also retards the application of gas pressure to lower diaphragm chamber 116 when valve 136 is initially opened. This retarding action due to orifice 126 effects a slower opening of valve 106. In some system applications, the slower opening of valve 106 is sufficiently slow so that, even with a slow responding or sluggish service regulator, contacts 90, 92, and 94 of pressure actuated switch 14 remain closed.

If during normal burner operation the electrical power fails, electromagnetically actuated valves 66 and 136 immediately close, causing all gas flow through valve device 10 to cease. With burner flame extinguished, bulb 204 begins to cool. Also, as described above, chamber 80 in pressure actuated switch 14 exhausts past valve 106 to effect disconnection of its contacts 90, 92 and 94, and valve 106 subsequently closes. Also, relay winding 224 is de-energized, effecting closing of its controlled contacts 222 and 230.

If electrical power is restored while switch 12 is still in its "hot" contact position, valve 66 cannot be opened because there is no energizing circuit for solenoid winding 78 which controls valve 66. Specifically, contacts 90, 92, and 94 in switch 14 are disconnected, and "cold" contacts 172 and 176 in switch 12 are open. Also, solenoid winding 148, which controls valve 136, cannot be energized because of open contacts 90, 92, and 94.

Relay winding 218 is also prevented from being energized due to open contacts 90, 92, and 94 in switch 14 and open "cold" contacts 172 and 176 in switch 12, so that igniter 20 cannot be energized. Also, relay winding 224 is prevented from being energized due to open contacts 90, 92, and 94 in switch 14. The system remains in this mode until bulb 204 cools sufficiently to enable "cold" contacts 172 and 176 in switch 12 to close.

Since switch 12 is constructed to make "hot" contacts 180 and 184 before breaking "cold" contacts 172 and 176 when bulb 204 is heated, it follows that, when bulb 204 cools, "cold" contacts 172 and 176 make before "hot" contacts 180 and 184 break.

When "cold" contacts 172 and 176 close, solenoid winding 78 is energized through thermostat 22, lead 220, relay contacts 222, lead 226, "cold" contacts 172 and 176, leads 228 and 236, solenoid winding 78, and lead 238. Relay winding 218 is also energized, the circuit being through thermostat 22, lead 220, relay contacts 222, lead 226, "cold" contacts 172 and 176, lead 228, relay contacts 230, lead 232, relay winding 218, and lead 234. Also energized when switch 12 is in its transitory intermediate contact position is solenoid winding 148, the circuit being through thermostat 22, lead 220, relay contacts 222, lead 226, contacts 172, 176, 180, and 184, solenoid winding 148, and leads 244 and 234.

Under the above conditions, gas flows to burner 16 and igniter 20 begins to heat. However, igniter 20 cannot heat fast enough and bulb 204 cannot respond fast enough to prevent switch 12 from breaking its "hot" contacts 180 and 184. That is to say, just as was the situation when bulb 204 was heating, switch 12 is in its intermediate contact position for only a second or two. Thus, within a second or two after "cold" contacts 172 and 176 are made, "hot" contacts 180 and 184 break. This condition, wherein gas flows and igniter 20 is incapable of igniting burner 16, is not considered hazardous since the amount of gas that flows for the second or two during which switch 12 is in its intermediate contact position is quite small.

With "hot" contacts 180 and 184 disconnected, solenoid winding 148 is de-energized, stopping the flow of gas to burner 16, and relay winding 218 and solenoid winding 78 remain energized. Under these conditions, igniter 20 is energized, valve 66 is open, and pressure switch contacts 90, 92, and 94 are closed, whereby a new burner cycle is initiated.

If during normal burner operation the gas supply fails or drops below a predetermined pressure, contacts 90, 92, and 94 in pressure actuated switch 14 open. This breaks the electrical circuits to solenoid windings 78 and 148, effecting the immediate closing of valves 66 and 136, respectively, and subsequent closing of valve 106. The circuit to relay winding 224 is also broken by the opening of contacts 90, 92, and 94, so that its controlled contacts 222 and 230 close. Under these conditions, the burner flame goes out and bulb 204 begins to cool. Upon resumption of an adequate gas supply, a new burner cycle is then automatically initiated in the same manner as described above for an electrical power interruption.

If for any reason other than an electrical power failure or a gas pressure failure ignition does not occur, or ignition occurs but the burner flame is not properly sensed by bulb 204, the system will lock out. For example, a low supply voltage at power terminals 30 and 32 might cause the igniter 20 to eventually radiate sufficient heat to effect closing of "hot" contacts 180 and 184 and opening of "cold" contacts 172 and 176 but not be hot enough to ignite the gas; the ports on burner 16 might be clogged with dirt or other foreign matter and prevent ignition; the bulb 204 might be improperly positioned so as not to be impinged by the burner flame; or there may be slugs of air in the gas supply. Under these conditions, the gas or air continues to flow until "hot" contacts 180 and 184 are disconnected.

Specifically, when switch 12 is actuated to its "hot" contact position, igniter 20 is de-energized. If ignition does not occur or if bulb 204 is not properly impinged by burner flame, bulb 204 begins to cool while gas continues to flow to burner 16. Since relay winding 224 is energized, its controlled contacts 222 and 230 are open. As bulb 204 cools down, switch 12 is moved to its intermediate contact position. This contact position does not change the operational state of the system since relay contacts 222 are open. That is to say, even when "cold" contacts 172 and 176 are made, relay winding 224 remains energized because relay contacts 222 are open, preventing shorting of the circuit comprising relay winding 224 and contacts 90, 92, and 94 of pressure actuated switch 14.

When bulb 204 has cooled sufficiently, "hot" contacts 180 and 184 open, causing solenoid winding 148 to be de-energized and effect closing of valve 136. Relay winding 224 remains energized through contacts 92, 94, and 90 of switch 14 and solenoid winding 78. Under this lockout condition, relay winding 224 remains energized, preventing gas flow to burner 16 and energizing of igniter 20.

Subsequent attempts at ignition may be effected by de-energizing relay winding 224. For example, if thermostat 22 is manually opened, relay winding 224 is de-energized, enabling its contacts 222 and 230 to close. When thermostat 22 is then re-closed, a new burner cycle is initiated. It should be noted that such subsequent attempts at ignition are discouraged since each unsuccessful attempt causes gas to accumulate in the combustion chamber in which burner 16 is located. It is therefore recommended that, before initiating any such subsequent attempt at ignition, the cause of the system malfunction be corrected.

DESCRIPTION AND OPERATION OF FIG. 3

Figure 3:
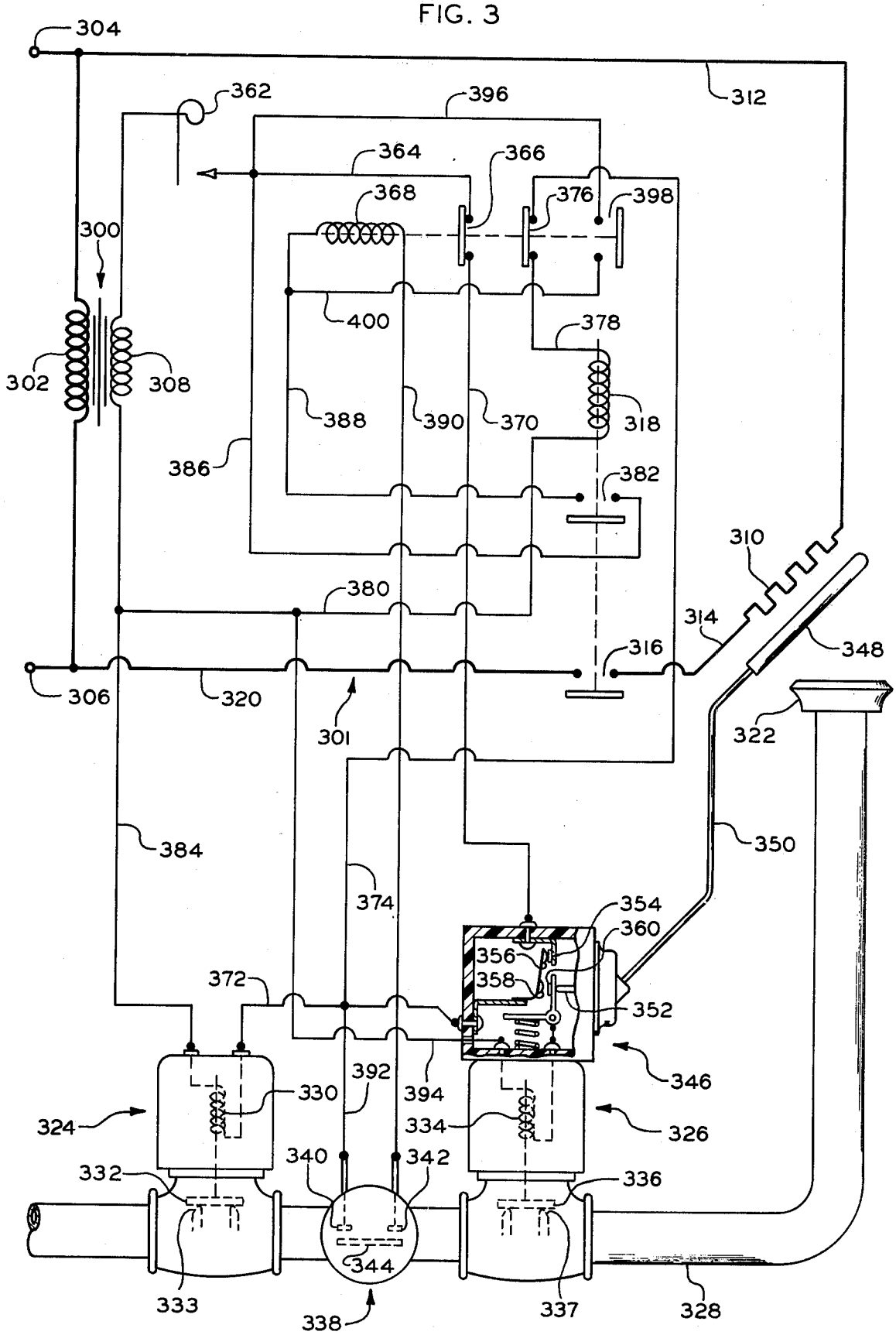
FIG. 3 is a diagrammatic illustration of an alternate burner control system constructed in accordance with the present invention.

An alternate construction of the burner control system of the present invention is shown in FIG. 3. The basic difference between the system of FIG. 3 and the system of FIG. 1 is that FIG. 3 is a system for controlling ignition and gas flow in which the gas valve device comprises two solenoid operated valves. Although many of the system components of FIG. 3 are identical with those of FIG. 1, different reference numerals will be used.

Referring to FIG. 3, a step-down transformer 300, in a control circuit indicated generally at 301, includes a primary winding 302 connected across terminals 304 and 306 of a 120 volt alternating current power source, and a secondary winding 308. An electrical resistance igniter 310 is connected by a lead 312 to power source terminal 304 and by a lead 314, a set of normally-open contacts 316 of a relay having a winding 318, and lead 320 to the other power source terminal 306.

Controlling the flow of gas to a burner 322 are two series-connected solenoid valves 324 and 326 positioned in a gas conduit 328 leading from a gas source (not shown) to burner 322. Gas valve 324 is a conventional solenoid-operated valve having a winding 330 and a valve member 332 cooperating with a valve seat 333. When solenoid winding 330 is energized, valve member 332 opens and allows gas to flow through valve 324. Similarly, conventional solenoid-operated valve 326 includes a winding 334 and a valve member 336 having a cooperating valve seat 337. Gas valves 324 and 326 are fluidically in series so that both valve member 332 and 336 must be open to allow gas to flow through conduit 328 to burner 322.

Interposed between valves 324 and 326 is a pressure actuated switch 338 having stationary contacts 340 and 342 and a movable contact 344. Switch 338 may be of any well-known conventional construction and is responsive to a predetermined gas pressure to cause contact 344 to connect contacts 340 and 342. Although illustrated as separate devices, it is to be understood that valves 324 and 326 and switch 338 may be incorporated in a single gas valve device.

A thermostatically actuated switch 346 is mounted to gas valve 326 in any convenient manner. Switch 346 is identical with switch 12 of FIG. 1 so a description of the details of construction will be omitted. As indicated in FIG. 3, switch 346 includes a sensing bulb 348, a capillary 350, an actuator rod 352, "cold" contacts 354 and 356, and "hot" contacts 358 and 360.

Relay winding 318 is connected across secondary winding 308 of transformer 300 through a thermostat 362, a lead 364, a set of normally-closed contacts 366 of a relay having a winding 368, a lead 370, "cold" contacts 354 and 356 of switch 346, a lead 372, a lead 374, another set of normally-closed contacts 376 controlled by relay winding 368, a lead 378, relay winding 318, and a lead 380. When relay winding 318 is energized, it effects closing of contacts 316 and another set of normally-open contacts 382.

Solenoid winding 330, which controls valve 332, is connected across secondary winding 308 through thermostat 362, lead 364, relay contacts 366, lead 370, "cold" contacts 354 and 356, lead 372, solenoid winding 330, and a lead 384.

When valve member 332 is open, gas flows through valve 324, effecting closing of contacts 340 and 342 by contact 344 in pressure actuated switch 338. When contacts 340, 342, and 344 are connected and when relay winding 318 is energized to effect closing of its contacts 382, a circuit is provided in parallel with normally-closed relay contacts 366 and "cold" contacts 354 and 356 of switch 346, the circuit being a lead 386, relay contacts 382, a lead 388, relay winding 368, a lead 390, contacts 342, 344 and 340 of pressure actuated switch 338, and a lead 392.

When thermostatically actuated switch 346 is in its intermediate contact position wherein "cold" contacts 354 and 356 are connected and "hot" contacts 358 and 360 are also connected, solenoid winding 334 in valve 326 is connected across secondary winding 308 through thermostat 362, lead 364, relay contacts 366, lead 370, contacts 354, 356, 358, and 360 of switch 346, solenoid winding 334, a lead 394 and lead 380.

When switch 346 is in its "hot" contact position wherein "hot" contacts 358 and 360 are connected and "cold" contacts 354 and 356 are disconnected, the above described parallel circuit comprising relay contacts 382, relay winding 368, and contacts 340, 342, and 344 of switch 338 is energized. When relay winding 368 is energized, a hold-in circuit therefore is provided by a circuit in parallel with relay contacts 382, the circuit being a lead 396, a set of normally-open contacts 398 controlled by relay winding 368, and a lead 400.

Except for the additional two sets of normally-open relay contacts 382 and 398, the relays of the system of FIG. 3 are the same as in FIG. 1. As will be hereinafter described, the additional relay contacts 382 and 398 are necessary because when valves 332 and 336 close, gas is trapped therebetween causing pressure switch contacts 340, 342, and 344 to remain closed.

The system is shown in FIG. 3 with valve members 332 and 336 closed on their respective seats 333 and 337, with thermostatically actuated switch 346 in its "cold" contact position, and with contacts 340, 342, and 344 of pressure actuated switch 338 disconnected. Under these conditions, no gas is flowing to burner 322 and igniter 310 is de-energized.

When thermostat 362 closes, solenoid winding 330 of valve 324 is energized through thermostat 362, lead 364, relay contacts 366, lead 370, "cold" contacts 354 and 356, lead 372, solenoid winding 330, and lead 384. Valve member 332 opens, allowing gas to flow to switch 338 and effect closing of contacts 340 and 342 by contact 344.

Connected in parallel with solenoid winding 330 and also energized when thermostat 362 closes is relay winding 318, the circuit being lead 374, relay contacts 376, lead 378, relay winding 318, and lead 380. With relay winding 318 energized, its controlled contacts 316 and 382 close.

With relay contacts 316 closed, igniter 310 begins to heat and the heat radiates to bulb 348. With relay contacts 382 closed, a circuit is connected in parallel with relay contacts 366 and "cold" contacts 354 and 356, the circuit being lead 386, relay contacts 382, lead 388, relay winding 368, lead 390, contacts 342, 344, and 340, and lead 392. However, as long as relay contacts 366 are closed and "cold" contacts 354 and 356 are closed, this latter described circuit is shorted, preventing relay winding 368 from being energized.

When igniter 310 is above ignition temperature of gas, bulb 348 moves actuator rod 352 sufficiently to cause "hot" contacts 358 and 360 to make. For a second or two, both the "cold" contacts 354 and 356 and the "hot" contacts 358 and 360 are connected, after which actuator rod 352 has moved sufficiently more to effect disconnecting of "cold" contacts 354 and 356.

In this intermediate contact position wherein contacts 354, 356, 358, and 360 are connected, solenoid winding 334 of valve 326 is energized by secondary winding 308 through thermostat 362, lead 364, relay contacts 366, lead 370, contacts 354, 356, 358, and 360 of switch 346, solenoid winding 334, and lead 394 and 380. Gas then flows to burner 322.

As was previously described with respect to FIG. 1, a sluggish service regulator may delay the supply of gas to burner 322. As was the situation in FIG. 1, the intermediate contact position of switch 346 is effective to maintain valve members 332 and 336 open and igniter 310 energized regardless of whether contacts 340, 342, and 344 in switch 338 are open or closed.

When "cold" contacts 354 and 356 are disconnected by additional movement of actuator rod 352, relay winding 368 is energized through relay contacts 382, contacts 340, 342, and 344 of switch 388, and a three-branch parallel circuit. Specifically, a circuit is completed from secondary winding 308 through thermostat 362, leads 364 and 386, relay contacts 382, lead 388, relay winding 368, lead 390, contacts 342, 344, and 340, and lead 392 through a first circuit comprising lead 372, solenoid winding 330 and lead 384, through a second parallel connected circuit comprising lead 374, relay contacts 376, lead 378, relay winding 318, and lead 380, and through a third parallel connected circuit comprising lead 372, "hot" contacts 358 and 360, solenoid winding 334, and leads 394 and 380. When relay winding 368 is energized, it effects opening of contacts 366 and 376 and closing of contacts 398.

Opening of contacts 376 effects de-energizing of relay winding 318. With relay winding 318 de-energized, its controlled relay contacts 316 open, de-energizing igniter 310. After igniter 310 is de-energized, switch 346 is maintained in its "hot" contact position by impingement of burner flame on bulb 348.

With relay winding 318 de-energized, its relay contacts 382 also open. However, since relay contacts 398, controlled by relay winding 368, are now closed and are in parallel with relay contacts 382, relay winding 368 remains energized.

With relay contact 366 open, desired system operation under various abnormal operating conditions is assured, as will be hereinafter described.

Under normal burner operation, burner 322 will continue to burn until thermostat 362 opens. When thermostat 362 opens, both valves 332 and 336 close, terminating burner operation.

Unless some means is provided to retard the closing of valve 336, gas will be trapped between valves 332 and 336 when thermostat 362 opens, causing contacts 340, 342, and 344 of switch 338 to remain closed. While this closed contact condition has no adverse effect under normal burner operation, it would cause the system to lock out, rather than automatically re-cycle, if there were an electrical power interruption. Accordingly, as will be hereinafter described, normally-open relay contacts 382 and 398 ensure desired system operation should contacts 340, 342, and 344 remain closed.

If during normal burner operation the electrical power fails, valves 332 and 336 close, and relay winding 368 is de-energized, effecting closing of relay contacts 366 and 376 and opening of relay contacts 398. If power is restored while switch 346 is still in its "hot" contact position, open relay contacts 398 and 382 prevent energizing of solenoid windings 330 and 334 and relay winding 318 even if contacts 340, 342, and 344 of pressure actuated switch 338 are closed.

When switch 346 is actuated to its intermediate contact position due to bulb 348 cooling down, solenoid winding 330 is energized through thermostat 362, lead 364, relay contacts 366, lead 370, "cold" contacts 354 and 356, lead 372, solenoid winding 330, and lead 384. Relay winding 318 is also energized through thermostat 362, lead 364, relay contacts 366, lead 370, "cold" contacts 354 and 356, leads 372 and 374, relay contacts 376, lead 378, relay winding 318, and lead 380. Also energized is solenoid winding 334, the circuit being through thermostat 362, lead 364, relay contacts 366, lead 370, contacts 354, 356, 358, and 360 of switch 346, solenoid winding 334, and leads 394 and 380. Under these conditions, gas flows to burner 322 and igniter 310 begins to heat. However, as was the situation in FIG. 1, igniter 310 cannot heat fast enough and bulb 348 cannot respond fast enough to prevent switch 346 from breaking "hot" contacts 358 and 360 within one or two seconds after being actuated to its intermediate contact position.

When "hot" contacts 358 and 360 are broken, solenoid winding 334 is de-energized, stopping the flow of gas to burner 322, and relay winding 318 and solenoid winding 330 remain energized. Under these conditions, igniter 310 is energized, valve 332 is open, contacts 340, 342, and 344 are closed, and relay contacts 382 are closed, whereby a new burner cycle is initiated.

If during normal burner operation the gas supply fails or drops below a predetermined pressure, contacts 340, 342, and 344 in pressure actuated switch 338 open. This breaks the electrical circuits to solenoid windings 330 and 334, effecting the closing of valves 332 and 336, respectively. Relay winding 368 is also de-energized so that its controlled contacts 366 and 376 close and contacts 398 open. Under these conditions, bulb 348 begins to cool. A new burner cycle is then automatically initiated in the same manner as described above for an electrical power interruption.

If ignition fails to occur or ignition occurs but the burner flame is not properly sensed by bulb 348, the system will lock out. Specifically, if ignition does not occur or bulb 348 is not properly impinged by burner flame, bulb 348 begins to cool while gas continues to flow to burner 322. Since relay winding 368 is energized, its controlled contacts 366 and 376 are open. When switch 346 is moved to its intermediate contact position, open relay contacts 366 prevent shorting of relay winding 368 so that relay winding 368 remains energized.

When "hot" contacts 358 and 360 open, solenoid winding 334 is de-energized, causing valve 336 to close. Under this lockout condition, relay winding 368 remains energized, preventing gas flow to burner 322 and preventing energizing of igniter 310. As was the situation in FIG. 1, subsequent attempts at ignition, after the cause of ignition failure has been corrected, may be effected by manually cycling thermostat 362 on and off.

It should be noted that the manifold gas valve device 10 of FIGS. 1 and 2 could be substituted for valve devices 324 and 326 and switches 338 and 346 of FIG. 3. While such a substitution would negate the functionally necessity of normally-open relay contacts 382 and 398, such a system would function properly and would enable using the same relay construction regardless of the type of valve utilized.

While a preferred embodiment of the present invention has been illustrated and described in detail in the drawings and foregoing description, it will be recognized that many changes and modifications will occur to those skilled in the art. It is therefore intended, by the appended claims, to cover any such changes and modifications as fall within the true spirit and scope of the invention.

We claim:

1. In a gas burner control system, a burner;

an electrical resistance igniter for igniting said burner;

two valves connected fluidically in series with said burner;

a thermostatically actuated switch responsive to igniter temperature and burner flame having a "cold" contact position, a "hot" contact position, and an intermediate contact position;

circuit means for effecting opening of a first of said two valves including said thermostatically actuated switch in said "cold" contact position;

circuit means for effecting energizing of said igniter including said thermostatically actuated switch in said "cold" contact position;

a pressure actuated switch actuated to a closed contact position when said first valve is open;

circuit means including said thermostatically actuated switch in said intermediate contact position for effecting opening of a second of said two valves so that gas flows to said burner in the event that said pressure actuated switch is actuated to an open contact position due to a momentary drop in gas pressure when said second valves opens; and circuit means energized through said pressure actuated switch in said closed contact position when said thermostatically actuated switch is moved into said "hot" contact position for maintaining said valves open and for effecting de-energizing of said igniter under normal burner operation, for automatically initiating a new burner cycle in the event of a power or gas failure, and for providing a lockout condition, wherein gas flow to said burner and energizing of said igniter is prevented, in the event ignition should not initially occur or is not responded to by said thermostatically actuated switch.

2. In a gas burner control system, a burner;

an electrical resistance igniter for igniting said burner;

two valves connected fluidically in series with said burner;

a thermostatically actuated switch responsive to igniter temperature and burner flame having a "cold" contact position in the absence of said igniter being at a temperature sufficient to ignite gas, a "hot" contact position when said igniter is above said temperature sufficient to ignite gas, and a transitory intermediate contact position wherein said switch is simultaneously in both said "cold" and "hot" contact positions;

a relay having a winding and two sets of normally-closed contacts;

circuit means for effecting opening of a first of said two valves including a series connection of said thermostatically actuated switch in said "cold" contact position and a first of said two sets of relay contacts;

circuit means for effecting energizing of said igniter including a series connection of said thermostatically actuated switch in said "cold" contact position, said first set of relay contacts, and a second of said two sets of relay contacts;

circuit means for effecting opening of a second of said two valves so that gas flows to said burner including a series connection of said thermostatically actuated switch in said intermediate contact position and said first set of relay contacts; and a pressure actuated switch actuated to a closed contact position when said first valve is open, said pressure actuated switch and said relay winding being electrically connected in series with each other and in parallel with said series connections of said first set of relay contacts and said thermostatically actuated switch in said "cold" and intermediate contact positions whereby said relay winding is initially shorted for enabling said thermostatically actuated switch to effect opening of said valves and to effect maintaining said valves open regardless of the contact position of said pressure actuated switch, and said series connected pressure actuated switch and relay winding being subsequently electrically connected in series with said thermostatically actuated switch in said "hot" contact position to effect opening of said two sets of relay contacts whereby said valves are maintained open and said igniter is de-energized under normal burner operation, a new burner cycle is automatically initiated in the event of a power or gas failure, and a lockout condition, wherein gas flow to said burner and energizing of said igniter is prevented, is provided in the event ignition should not initially occur or is not responded to by said thermostatically actuated switch.

3. In a gas burner control system, a burner;

first and second valves connected fluidically in series with said burner, each of said valves having a controlling electrical winding;

an electrical resistance igniter for igniting said burner;

a first relay having a winding and two sets of normally-open contacts, a first set of which are effective when closed to connect said igniter to an electrical power source;

a second relay having a winding, two sets of normally-closed contacts and one set of normally-open contacts;

a pressure actuated switch located between said first and second valves and actuated to a closed contact position in response to a predetermined gas pressure when said first valve is open;

thermostatically actuated switch means including a temperature sensing portion responsive to heat radiated from said igniter and to burner flame, and a switch having "cold" contacts which are closed when said igniter is below a temperature sufficient to ignite gas and "hot" contacts which are closed when said igniter is above said temperature sufficient to ignite gas, said thermostatically actuated switch being constructed so as to close said "hot" contacts before opening said "cold" contacts as said temperature sensing portion responds to heat radiated from said igniter, defining a transitory intermediate contact position;

circuit means connecting a first of said two sets of normally-closed contacts of said second relay, said "cold" contacts, and said winding of said first valve for effecting opening of said first valve;

circuit means connecting said first set of normally-closed contacts of said second relay, said "cold" contacts, a second of said two sets of normally-closed contacts of said second relay, and said winding of said first relay for effecting energizing of said igniter;

circuit means connecting said first set of normally-closed contacts of said second relay, said "cold" and "hot" contacts when said thermostatically actuated switch is in said intermediate contact position, and said winding of said second valve for effecting opening of said second valve whereby gas flows to said burner;

circuit means connecting a second of said two sets of normally-open contacts of said first relay, said winding of said second relay, and said pressure actuated switch in series with each other and in parallel with said first set of normally-closed contacts of said second relay and said "cold" contacts for effecting energizing of said winding of said second relay when said "cold" contacts are open; and circuit means connecting said normally-open contacts of said second relay in parallel with said second set of normally-open contacts of said first relay for maintaining said winding of said second relay energized when said winding of said first relay is de-energized.

4. In a gas burner control system, a burner;

an electrical resistance igniter for igniting said burner;

first and second valves connected fluidically in series with said burner, said first valve including a controlling electrical winding, said second valve being a pressure operated valve located downstream from said first valve and defining a chamber therebetween;

a first expansible chamber operatively connected to and effective to open said second valve when sufficient gas pressure is applied therein;

a first branch passageway leading from said chamber between said first and second valves to said first expansible chamber;

a third valve in said first branch passageway for controlling flow of gas to said first expansible chamber and including a controlling electrical winding;

a pressure actuated switch having an open contact position and a closed contact position;

a second expansible chamber in communication with said chamber between said first and second valves and operatively connected to and effective to actuate said pressure actuated switch to said closed contact position when sufficient gas pressure is applied therein;

a second branch passageway leading from said first branch passageway between said third valve and said first expansible chamber to a point downstream from said second valve for exhausting said first expansible chamber when said first or said third valve closes, which exhausting enables said second valve to close;

orifice means in said first branch passageway for retarding said exhausting of said first expansible chamber so as to enable said second expansible chamber to exhaust past said second valve before said second valve closes, so that said pressure actuated switch is in said open contact position whenever said first and second valves are closed;

a first relay having a winding and a set of normally-open contacts effective when closed to connect said igniter to an electrical power source;

a second relay having a winding and two sets of normally-closed contacts;

thermostatically actuated switch means including a temperature sensing portion responsive to heat radiated from said igniter and to burner flame, and a switch having "cold" contacts which are closed when said igniter is below a temperature sufficient to ignite gas and "hot" contacts which are closed when said igniter is above said temperature sufficient to ignite gas, said thermostatically actuated switch constructed so as to close said "hot" contacts before opening said "cold" contacts as said temperature sensing portion responds to heat radiated from said igniter, defining a transitory intermediate contact position;

circuit means connecting a first of said two sets of normally-closed contacts of said second relay, said "cold" contacts, and said winding of said first valve for effecting opening of said first valve;

circuit means connecting said first set of normally-closed contacts of said second relay, said "cold" contacts, a second of said two sets of normally-closed contacts of said second relay, and said winding of said first relay for effecting energizing of said igniter;

circuit means connecting said first set of normally-closed contacts of said second relay, said "cold" and "hot" contacts when said thermostatically actuated switch is in said intermediate contact position, and said winding of said third valve for effecting opening of said third valve which effects opening of said second valve, enabling gas to flow to said burner; and circuit means connecting said winding of said second relay and said pressure actuated switch in series with each other and in parallel with said first set of normally-closed contacts of said second relay and said "cold" contacts for effecting energizing of said winding of said second relay when said "cold" contacts are open.

* * * * *